US006401771B1

(12) United States Patent
Kondo et al.

(10) Patent No.: US 6,401,771 B1
(45) Date of Patent: Jun. 11, 2002

(54) CLEANING DEVICE FOR FILLING NOZZLES

(75) Inventors: Masakatsu Kondo; Yoji Nishio; Yasuji Fujikawa; Michio Ueda, all of Tokushima (JP)

(73) Assignee: Shikoku Kakoki Co., Ltd, Tokushima (JP)

( * ) Notice: Subject to any disclaimer, the term of this patent is extended or adjusted under 35 U.S.C. 154(b) by 0 days.

(21) Appl. No.: 09/968,866

(22) Filed: Oct. 3, 2001

(30) Foreign Application Priority Data

Oct. 5, 2000 (JP) ..... 2000-306228

(51) Int. Cl.[7] ..... B65B 1/04; B65B 3/04; B67C 3/02

(52) U.S. Cl. ..... 141/90; 141/91; 134/166 R

(58) Field of Search ..... 141/89–91; 134/166 R, 134/169 R, 171

(56) References Cited

U.S. PATENT DOCUMENTS 3,430,639 A * 3/1969 Roberts ..... 134/169 R
5,095,958 A * 3/1992 Tincati ..... 141/129
5,845,683 A * 12/1998 Sundby et al. ..... 141/90

FOREIGN PATENT DOCUMENTS

| | | |
|---|---|---|
| EP | 0 785 134 | 7/1997 |
| EP | 0 919 517 | 6/1999 |
| JP | 11-165797 | 6/1999 |

* cited by examiner

*Primary Examiner*—Timothy L. Maust
(74) *Attorney, Agent, or Firm*—Armstrong, Westerman & Hattori, LLP

(57) ABSTRACT

A filling nozzle cleaning device comprises an adaptor 74 having an upward socket 131 connectable to a downward discharge outlet 51 of a filling nozzle 41 disposed above a bed 11, a collecting pipe 73 having a vertical pipe portion 121 communicating with the socket 131 and extending through the bed 11 rotatably and upwardly and downwardly movably, and a drive mechanism for moving the adaptor 74 so as to advance the socket 131 to or retract the socket 131 from below the discharge outlet 51 and connect the socket 131 to the discharge outlet 51 when the socket is advanced. The drive mechanism has a rotary actuator 161 and a fluid pressure cylinder 165 which are connected to the vertical pipe portion 121 below the bed 11 for rotating and upwardly and downwardly moving the pipe portion 121.

5 Claims, 10 Drawing Sheets

CLEANING DEVICE FOR FILLING NOZZLES

BACKGROUND OF THE INVENTION

The present invention relates to a cleaning device for the filling nozzles of liquid filling apparatus which are adapted to fill a beverage or like liquid into containers.

As disclosed in JP-A No. 11-165797, a device of the type mentioned is already known for use in liquid filling apparatus which comprise a container conveyor provided on a bed, and a filling nozzle disposed above a path of transport of containers and having a downward discharge outlet. The known device comprises an adaptor having an upward socket connectable to the discharge outlet and provided integrally with a collecting pipe, with the socket in communication with the collecting pipe, and a drive mechanism for moving the adaptor so as to advance the socket to below the discharge outlet or retract the socket from below the outlet and to connect the socket to the discharge outlet when the socket is advanced. The drive mechanism comprises an upwardly-downwardly pivotally movable arm having the adaptor attached thereto so as to make the adaptor movable in a longitudinal direction and supported by a stand on the bed so as to advance the adaptor to below the discharge outlet or retract the adaptor from below the outlet, a first fluid pressure cylinder mounted on the arm so as to be pivotally movable therewith and having a piston rod connected to the adaptor, and a second fluid pressure cylinder mounted on the bed upwardly or downwardly pivotally movably and having a piston rod connected to the arm.

A collecting pump is disposed below the bed, and the collecting pipe is connected to the pump while bypassing the bed.

With the conventional device described, the drive mechanism is installed on the bed in the vicinity of the filling nozzle. The device therefore has the problem of being complex in the construction on the bed in the vicinity of the filling nozzle.

SUMMARY OF THE INVENTION

An object of the present invention is to overcome the above problem and to provide a cleaning device for filling nozzles which is simplified in construction on the bed in the vicinity of the filling nozzles to ensure greatly improved sanitation and remarkably facilitated maintenance.

The present invention provides a cleaning device comprising an adaptor having an upward socket connectable to a downward discharge outlet of a filling nozzle disposed above a bed, a collecting pipe integral with the adaptor so as to communicate with the socket, and a drive mechanism for moving the adaptor so as to advance the socket to below the discharge outlet or retract the socket from below the outlet and to connect the socket to the discharge outlet when the socket is advanced, the collecting pipe having a vertical pipe portion, the vertical pipe portion extending through the bed rotatably and upwardly and downwardly movably at a position away from the discharge outlet by a distance equal to the distance by which the socket is horizontally spaced apart from the vertical pipe portion, the drive mechanism having an actuator connected to the vertical pipe portion at a position below the bed for rotating and upwardly and downwardly moving the pipe portion.

With the filling nozzle cleaning device of the present invention, the socket of the adaptor is connected to and disconnected from the discharge outlet of the filling nozzle by rotating and upwardly and downwardly moving the vertical pipe portion of the collecting pipe. Moreover, the pipe portion is rotated and upwardly and downwardly moved from below the bed by the actuator of the drive mechanism. Accordingly, the vertical pipe portion of the collecting pipe alone is provided on the bed in the vicinity of the filling nozzle, with none of the drive mechanism and the like present thereon. This ensures very satisfactory sanitation and maintenance in the vicinity of the filling nozzle.

A container conveyor extends below the filling nozzle, and a vertical tubular stand is installed on the bed and fitted around the vertical pipe portion so as to render the pipe portion free to rotate and move upward and downward, the stand being adjustable in position in directions parallel to a path of transport by the conveyor. If the chains and the like of the conveyor become elongated, the position of the stand is so adjusted as to accommodate the stand to the elongation, whereby the position of the adaptor can be adjusted easily.

A cleaning nozzle having a downward cleaning opening is disposed below a path of rotation of the socket centered about the vertical pipe portion, and the cleaning nozzle is fixed to the stand. When disconnected from the discharge outlet, the socket can then be held connected to the cleaning opening. This obviates the likelihood that the adaptor will be contaminated with the ambient atmosphere. Moreover, the position of the cleaning nozzle can be adjusted simultaneously with the position adjustment of the adaptor.

The actuator comprises a rotary actuator having a body restrained from rotating about the axis of the vertical pipe portion but free to move upward or downward and a rotary shaft projecting upward from the body and connected to a lower end of the vertical pipe portion, and an actuator of the straight moving type having a straight movable rod extending in parallel to the axial direction of the vertical pipe portion and connected to the body. The vertical pipe portion can then be rotated and upwardly and downwardly moved by a simple mechanism comprising the actuators of the rotary type and the straight moving type only.

The vertical pipe portion has a collecting hole below the bed, and a shell is fitted around the pipe portion and covers the collecting hole, the shell rendering the pipe portion free to rotate and being movable with the pipe portion upward and downward, a flexible pipe having one end connected to the shell and the other end connected to a collecting pump. The liquid collected by the adaptor can then be promptly guided to below the bed without being allowed to remain on the bed. This contributes to further improved sanitation, also providing a shortened path from the adaptor to the collecting pump to achieve a higher efficiency in circulating the cleaning liquid and eliminating the likelihood of the collecting pump incorporating air into the liquid.

DESCRIPTION OF THE PREFERRED EMBODIMENT

An embodiment of the present invention will be described below with reference to the drawings.

The term "front" as used in the following description refers to the side of the plane of FIG. 1 away from the viewer's side and perpendicular to the plane (toward the direction of the arrow A in FIG. 1), and the opposite side is referred to as "rear." The terms "left" and "right" refer respectively to the left and right sides (left-hand and right-hand sides of FIG. 1) of the illustrated device as it is seen from the rear forward.

Figure 1:
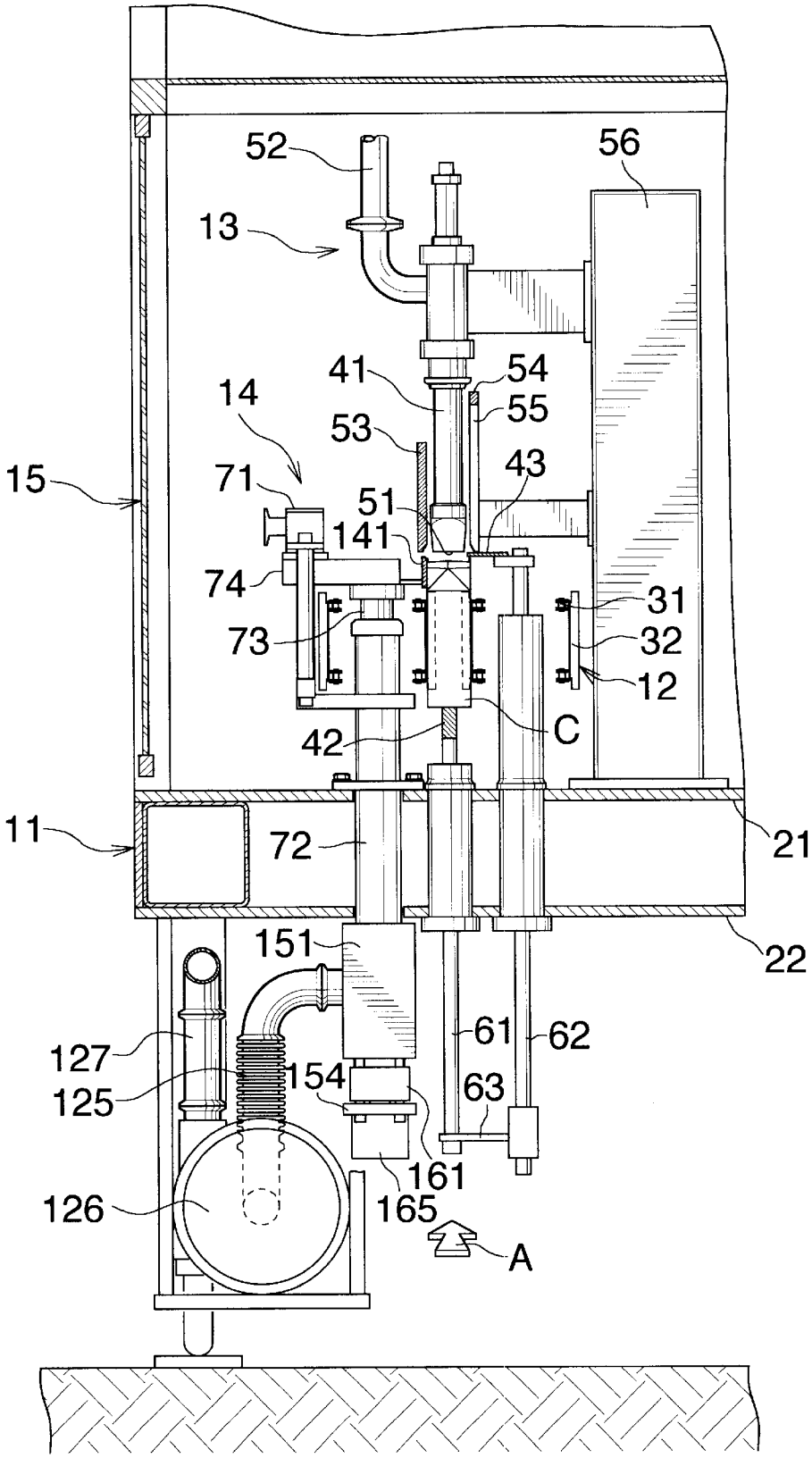
FIG. 1 is a view in cross section showing a cleaning device of the invention and surroundings thereof.

FIG. 1 shows a bed 11, a container conveyor 12 having a path of transport extending forward above the bed 11, a filling device 13 and cleaning device 14 which are arranged at an intermediate portion of the transport path, and a clean room 15 having accommodated therein the conveyor 12, filling device 13 and cleaning device 14 and providing a required packaging space.

The bed 11 is in the form of a horizontal flat hollow body having a thickness in the vertical direction and having a top wall 21 and a bottom wall 22.

The conveyor 12 has a pair of left and right endless chains 31 and a multiplicity of holders 32 attached to the chains. The chains 13 are driven intermittently to simultaneously transport three containers C as held by holders 32 at a time by one cycle.

The filling device 13 comprises three filling nozzles 41 disposed above the container transport path and corresponding to the three containers C to be transported by one cycle, a lifter 42 for raising the containers C from the holders 32, and a pusher 43 for pushing down the containers C raised by the lifter 42 back to the holders 32.

Figure 3:
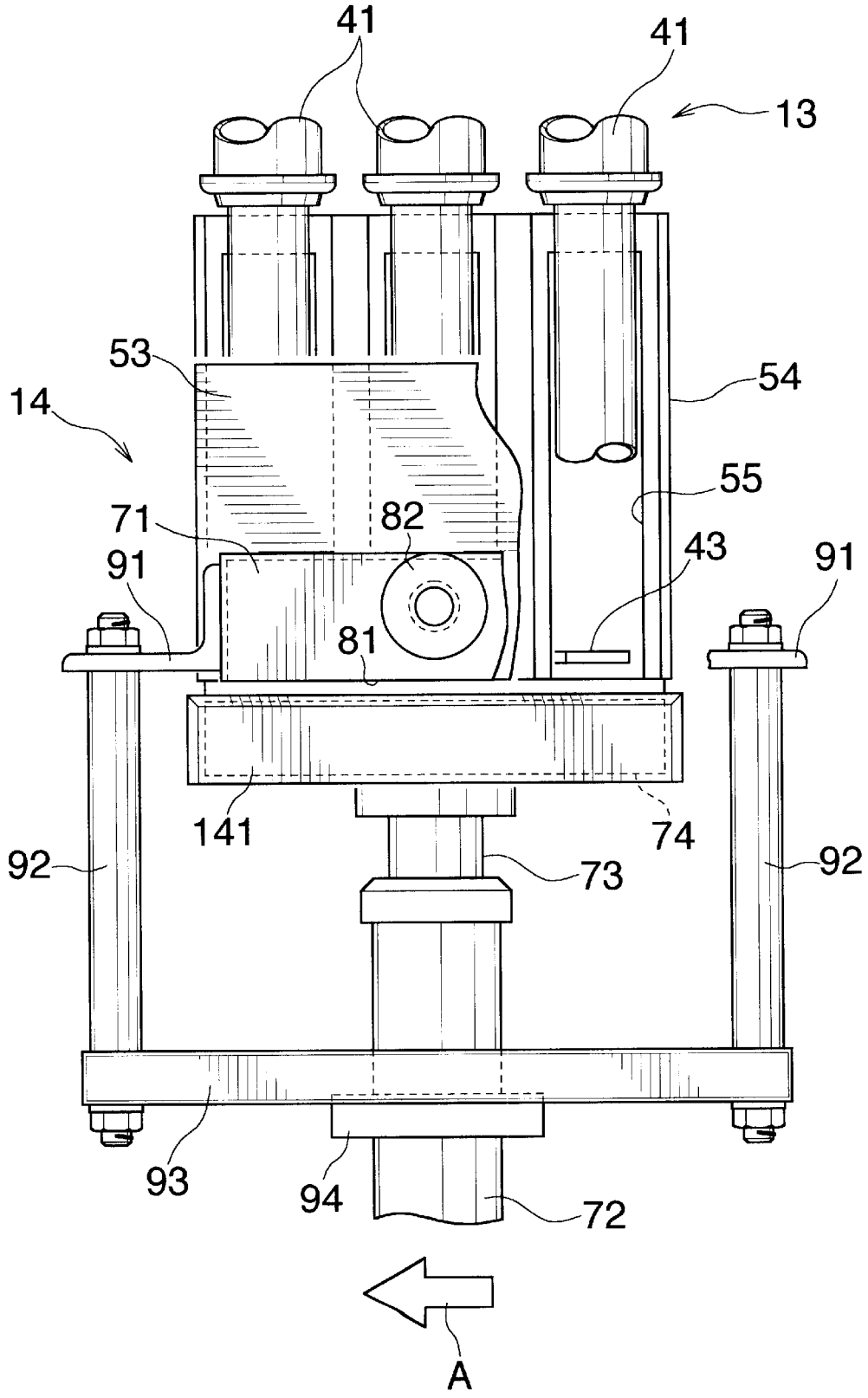
FIG. 3 is a view in section taken along the lines III—III in FIG. 2.

The filling nozzle 41 is in the form of a vertical tube and has a downward discharge outlet 51 at its lower end. The filling nozzle 41 is connected by a connecting pipe 52 to an unillustrated tank for the liquid to be filled. Arranged at the left and right sides of the filling nozzle 41 are a left fixed guide 53 and a right fixed guide 54, each in the form of a vertical plate, for guiding the containers to be moved upward and downward by the lifter 42 and the pusher 43. Formed in the left fixed guide 54 are slits 55 for avoiding interference with the pusher 43 (FIG. 3).

The filling nozzle 41, left fixed guide 53 and right fixed guide 54 are supported by a box frame 56 provided upright on the bed 11. By unillustrated means, the box frame 56 is made adjustable in position in the direction of transport by the conveyor. The position of the box frame 56 is adjusted in corresponding relation, for example, with the elongation of the chains 31.

The lifter 42 is attached to the upper end of a pushing up lift rod 61 disposed immediately below the filling nozzle 41, while the pusher 43 is attached to the upper end of a pushing-down lift rod 62 disposed at the right of the rod 61. The lift rods 61, 61 extend through the bed 11 and have lower ends projecting downward below the bed 11. The downwardly projecting portions of the rods 61, 62 are interconnected by a connecting rod 63. The two lift rods 61, 62 are driven by unillustrated means so as to move upward and downward at the same time.

The cleaning device 14 comprises a cleaning nozzle 71 disposed at the left of the filling nozzle 41, a vertical tubular stand 72 disposed between and below the cleaning nozzle 71 and the filling nozzles 41, a cleaning liquid collecting pipe 73 extending through the stand 72, and an adaptor 74 for connecting the filling nozzles 41 and the cleaning nozzle 71 alternately to the collecting pipe 73.

Figure 4:
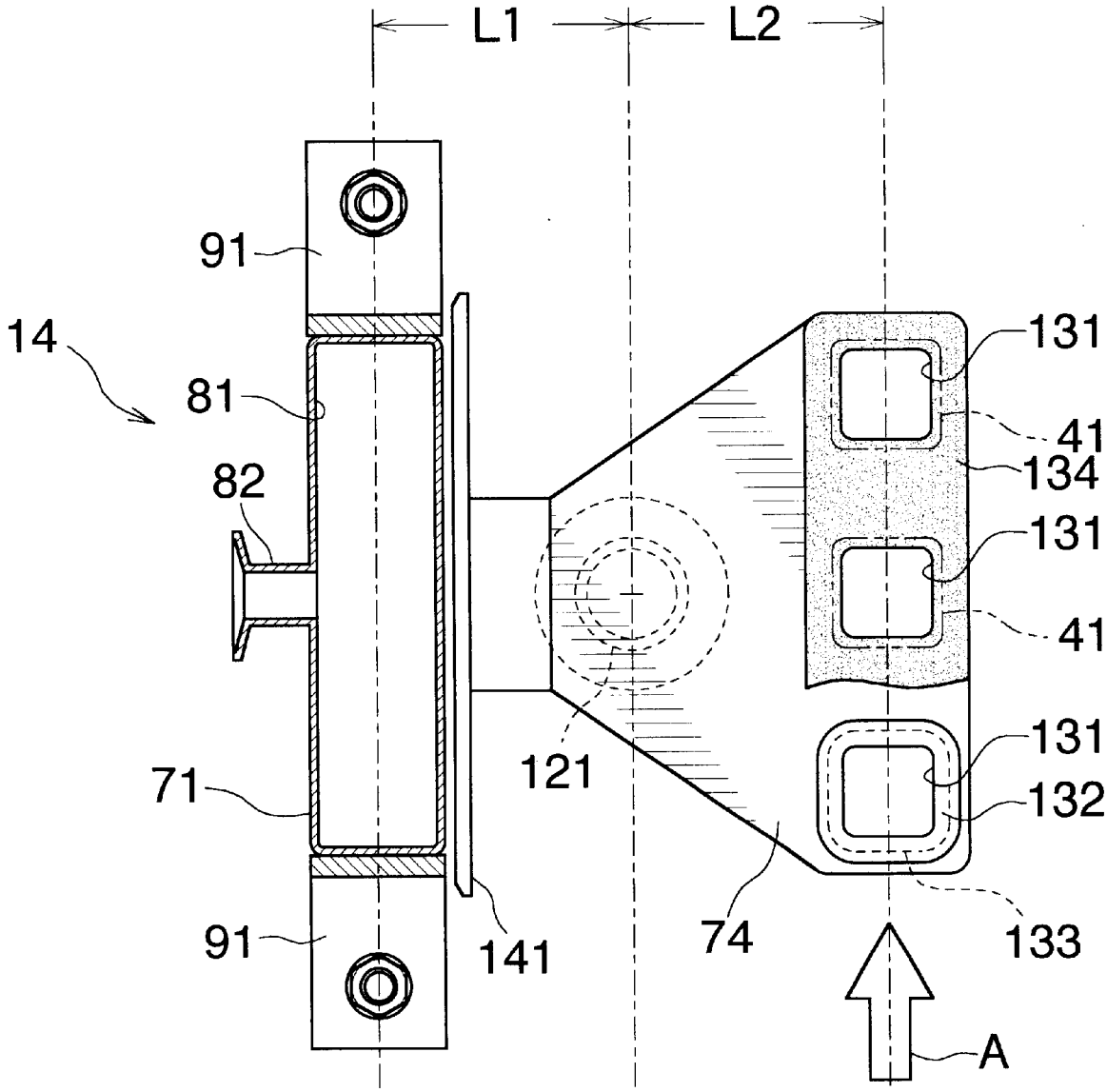
FIG. 4 is a view in horizontal section taken along the line IV—IV in FIG. 2.

As shown in detail in FIG. 4, the cleaning nozzle 71 is in the form of a horizontal tube of rectangular cross section extending from the front rearward, having a length corresponding to the three nozzles and provided with a cleaning opening 81 provided by the absence of a wall from the entire bottom area. The cleaning opening 81 is at the same level as the discharge outlets 51. A supply tube portion 82 projects leftward from the midportion of left side wall of the cleaning nozzle 71.

With reference to FIG. 3, the cleaning nozzle 71 is supported at its front and rear ends by angles 91 on the upper ends of a pair of vertical rods 92. The vertical rods 92 are interconnected at their lower ends by a horizontal connecting bar 93. The connecting bar 93 is supported by a bracket 94 provided on the stand 72 and projecting leftward.

Figure 5:
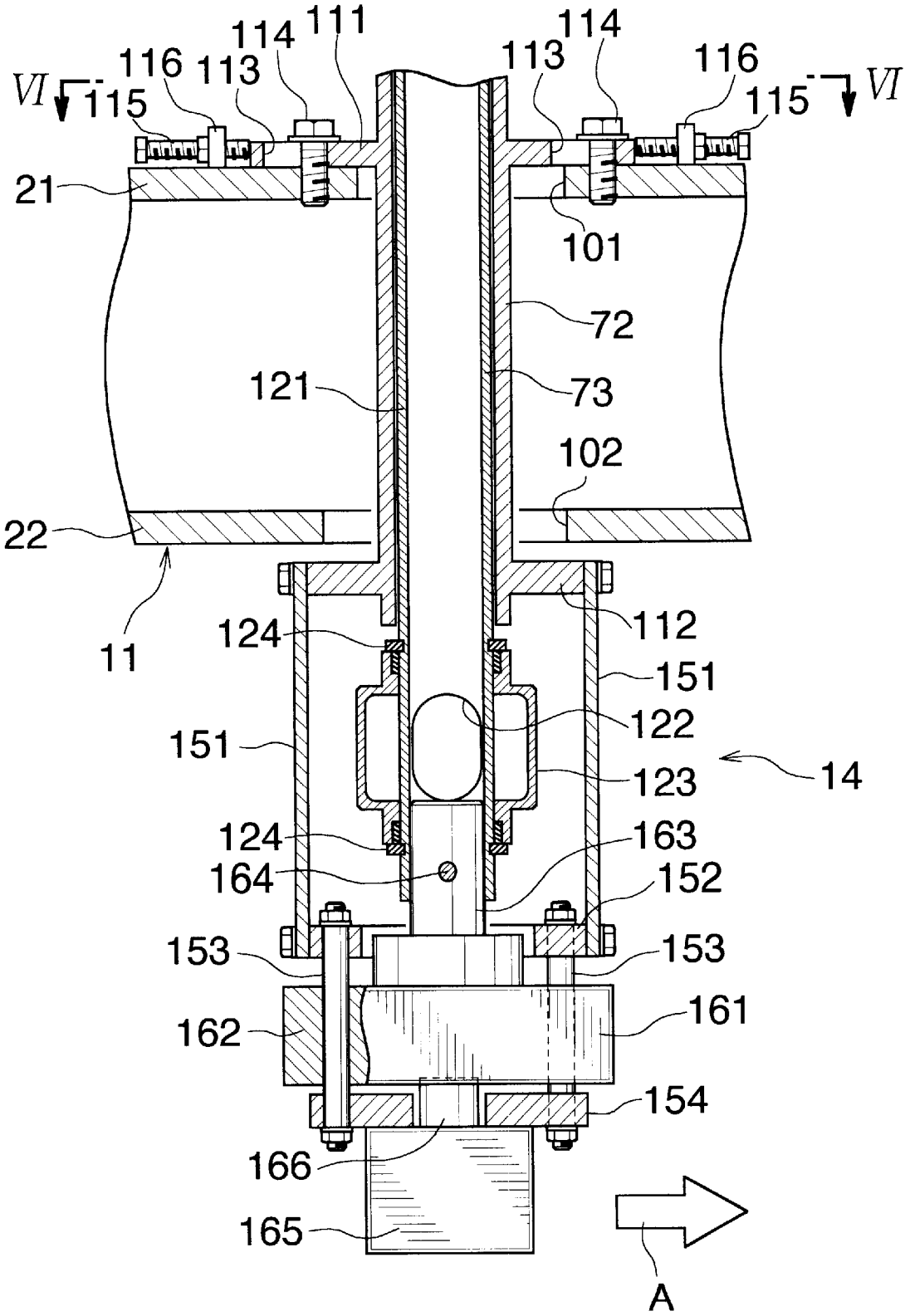
FIG. 5 is a view in vertical section taken along the line V—V in FIG. 2.

As shown in FIG. 5 most apparently, the stand 72 extends through the bed 11. The portions of the top wall 21 and the bottom wall 22 of the bed 11 where the stand 72 extends through these walls are provided with upper and lower large slots 101, 102 which are elongated from the front rearward.

The stand 72 is provided with an upper rectangular flange 111 at an intermediate portion of the length thereof and with a lower rectangular flange 112 at the lower end thereof. The upper flange 111 is supported by the upper surface of edge portion around the slot 101. The lower flange 112 is positioned below the bottom wall 22.

Figure 6:
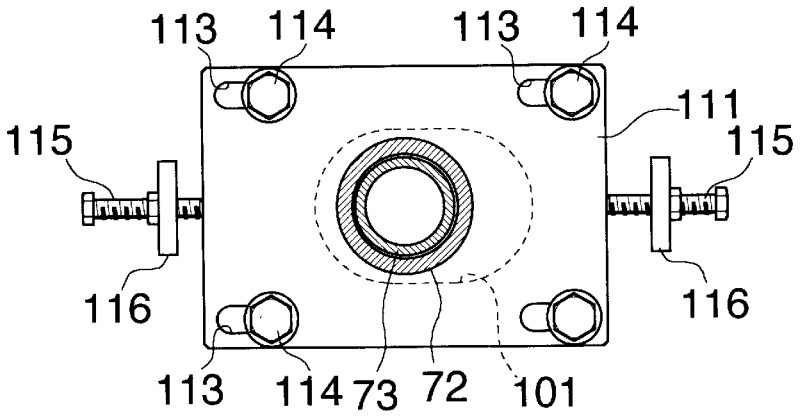
FIG. 6 is a view in horizontal section taken along the line VI—VI in FIG. 5.

With reference to FIG. 6 in addition to FIG. 5, four small slots 113 elongated from the front rearward are formed respectively at the four corners of the upper flange 111. A fastening bolt 114 is screwed into the top wall 21 through each small slot 113. The upper flange 111 is held between front and rear position adjusting bolts 115. Each position adjusting bolt 115 is mounted on the upper surface of the top wall 21 by an internally threaded member 116.

The stand 72 is moved forward or rearward by loosening the fastening bolts 114, advancing one of the position adjusting bolts 115 and retracting the other bolt 115. The stand 72 as moved is then fixed by the fastening bolts 114, whereby the position of the stand 72 is adjusted to thereby accommodate the stand, for example, to the elongation of the chains 31 as is the case with the box frame 56.

The collecting pipe 73 has a vertical pipe portion 121 fitted in the stand 72, rotatable and movable upward and downward. The pipe portion 121 has upper and lower ends projecting upward and downward from the stand 72.

The pipe portion 121 is provided with two collecting holes 122 formed in the lower end part and opposed to each other, and with a shell 123 fitting around the end part and covering the holes 122. The pipe portion 121 is free to rotate relative to the shell 123. The shell 123 is held between retaining rings 124 from above and below, whereby the shell 123 is made movable upward or downward along with the pipe portion 121. An L-shaped flexible pipe 125 has an upper end connected to the shell 123 and a lower end connected to an inlet of a collecting pump 126 suspended from the bed 11 (FIG. 1). A drain pipe 127 is connected to an outlet of the pump 126.

As shown in FIG. 4, the adaptor 74 is in the form of a flat hollow body generally triangular when seen from above and having a thickness in the vertical direction. At the vertex portion of the triangular body, the adaptor 74 has a bottom wall portion joined to the upper end of the vertical pipe portion 121 in communication therewith. At the base of the triangle, the adaptor 74 has a top wall portion provided with three sockets 131 arranged in a row and corresponding to the discharge outlets 51 of the three filling nozzles 41. The edge of each socket 131 provides an annular upward projection 132, with an annular groove 133 formed along the outer periphery of the projection. The adaptor 74 has a packing 134 fitting in the annular grooves 133 of the three projections 132 (see FIG. 2).

The adaptor 74 is provided with a movable guide plate 141 in the form of a vertical strip and extending horizontally at one side of the vertical pipe portion 121 opposite to the sockets 131.

With reference to FIG. 4, the distance L1 from the axis of the vertical pipe portion 121 to the center line of width of the cleaning opening 81 is made equal to the distance L2 from the axis to a line through the centers of the three sockets 131. Further with reference to FIG. 8, the distance L3 from the axis of the pipe portion 121 to the guide surface of the left fixed guide 53 is made equal to the distance L4 from the axis to the guide surface of the movable guide 141.

As shown in detail in FIG. 5, the lower flange 112 of the stand 72 has a horizontal upper support plate 152 suspended therefrom by a pair of front and rear vertical suspenders 151 opposed to each other. A horizontal lower support plate 154 is suspended from the upper support plate 152 by four depending guide rods 153.

The guide rods 153 extend through the body 162 of a rotary actuator 161, permitting the body to move upward or downward along the rods. The rotary actuator 161 has an upward output shaft 163, which is fitted in the lower end of the vertical pipe portion 121 and fixed to the lower end with a pin 164. Attached to the lower support plate 154 is a fluid pressure cylinder 165 as directed upward. The cylinder 165 has a piston rod 166 connected to the body 162 of the rotary actuator 161.

When the rotary actuator 161 is operated, the vertical pipe portion 121 is rotated along with the output shaft 163. When the piston rod 166 is advanced by operating the fluid pressure cylinder 165, the pipe portion 121 is raised with the rotary actuator 161, while when the piston rod 166 is retracted, the pipe portion 121 is lowered with the actuator 161.

Figure 2:
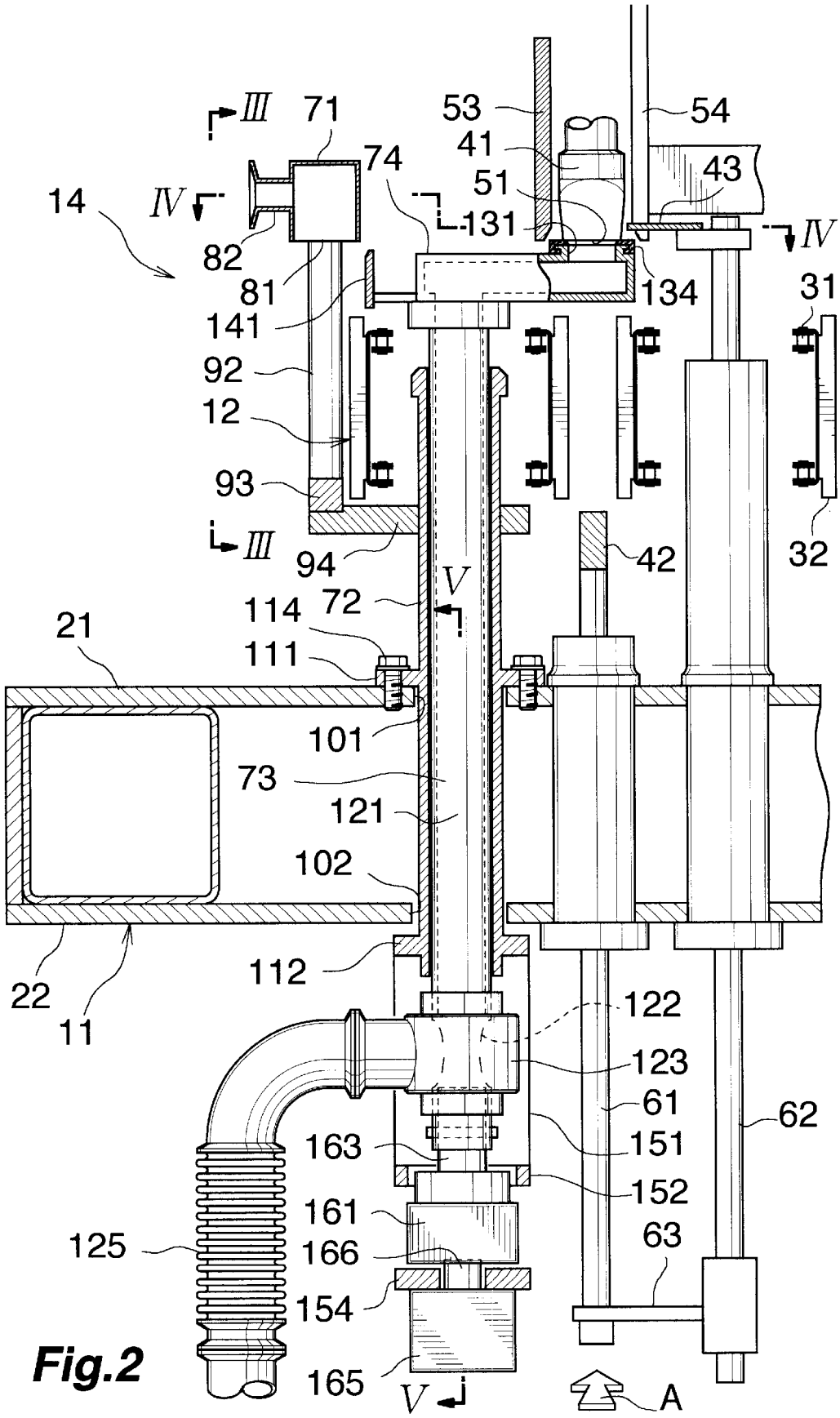
FIG. 2 is an enlarged fragmentary view in cross section of FIG. 1.

The sockets 131 of the adaptor 74 are connected to the respective discharge outlets 51 of the filling nozzles 41 as shown in FIG. 2 when the nozzles 41 are to be cleaned. In this state, the cleaning liquid is sent into the filling nozzles 41 through the tank for the liquid to be filled. The cleaning liquid to be used is, for example, chlorine water. The cleaning liquid sent into the nozzles 41 is collected via the pipe 73 by the operation of the collecting pump 126.

Figure 7:
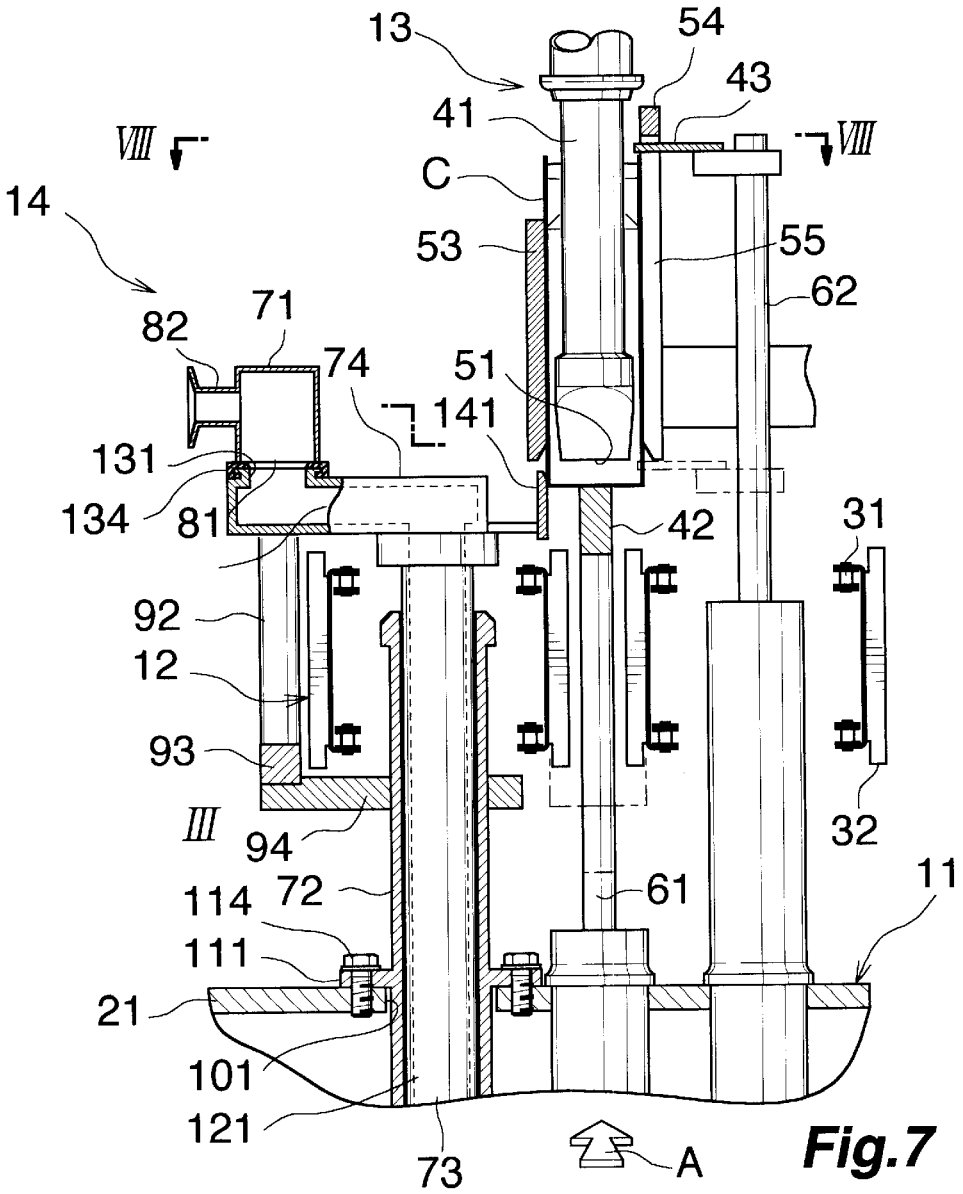
FIG. 7 is a cross sectional view corresponding to FIG. 2 and showing the device during filling.
Figure 8:
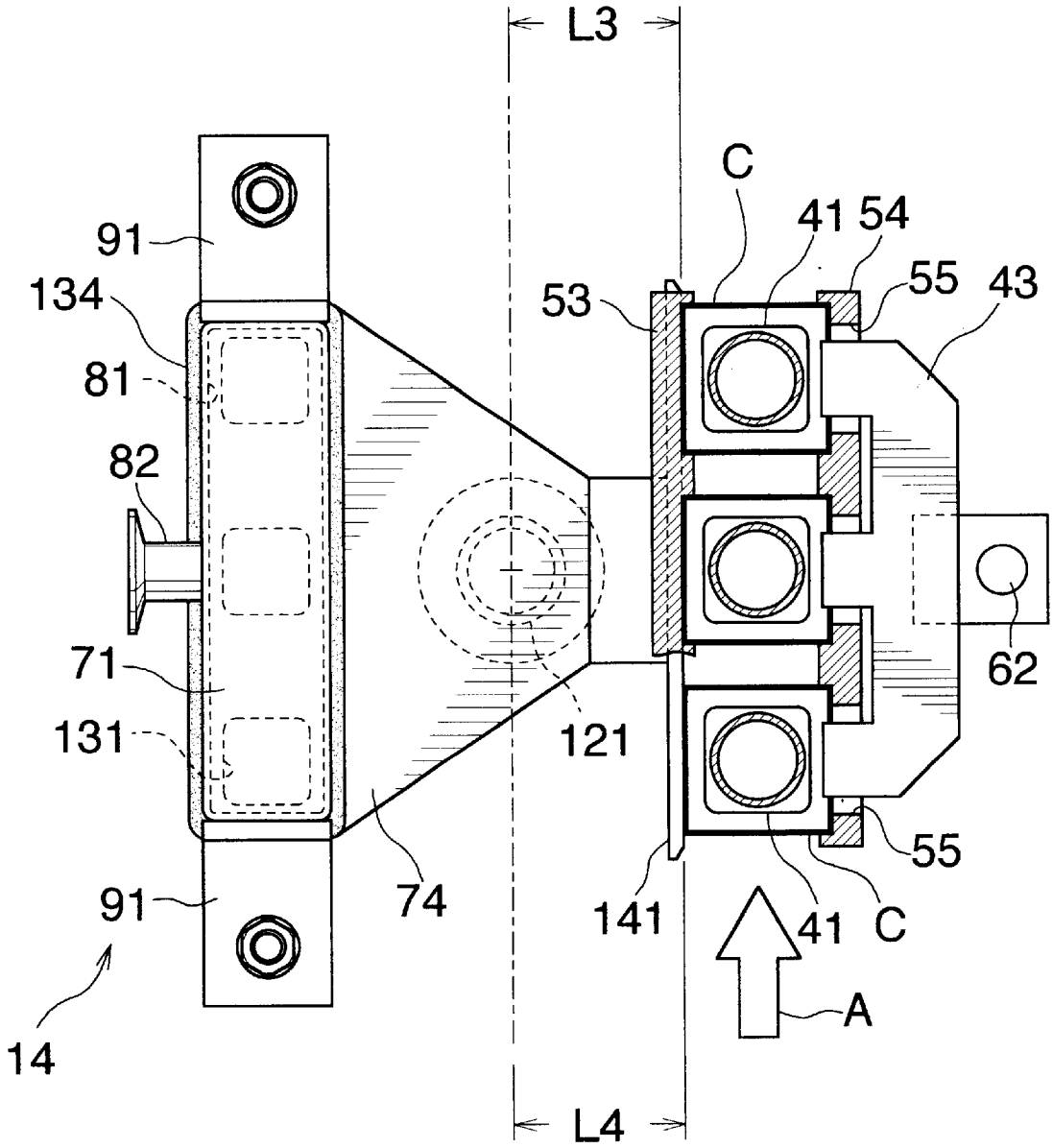
FIG. 8 is a view in horizontal section taken along the line VIII—VIII in FIG. 7 and corresponding to FIG. 4.

When the operation of cleaning the filling nozzles 41 is completed and to be changed over to the usual filling operation, the vertical pipe portion 121 is lowered, then turned through 180 degrees and thereafter raised, whereby the sockets 131 of the adaptor 74 are connected to the cleaning opening 81 of the cleaning nozzle 71. FIGS. 7 and 8 show this state. When required, the cleaning liquid is supplied to the cleaning nozzle 71.

During the usual filling operation, the movable guide 141 is positioned under the left fixed guide 53 and approximately flush therewith. The containers C raised by the lifter 42 are completely slipped out of the holders 32 upward and held by the left and right fixed guides 53, 54. Although there is a clearance between the holder 32 and the guides 53, 54, the clearance is compensated for by the movable guide 141. When the containers C as raised by the lifter 42 are to be returned to the holders 32 by being pushed down by the pusher 43, there is a likelihood that the container C will not be returned to the holders 32 smoothly if the movable guide 141 is absent, whereas the guide 141 obviates the likelihood.

Figure 9:
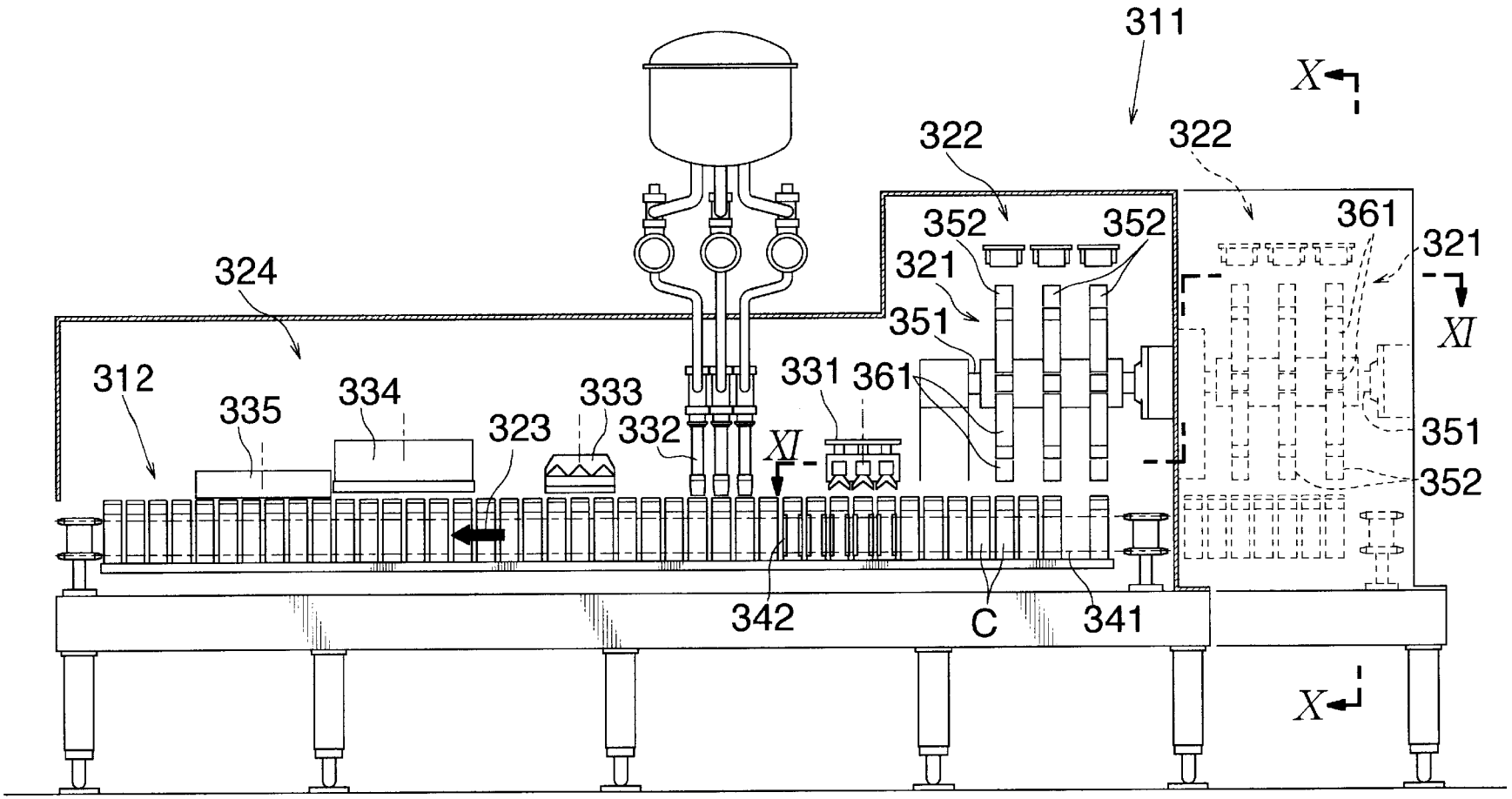
FIG. 9 is a side elevation of a packaging machine equipped with the device of the invention.
Figure 10:
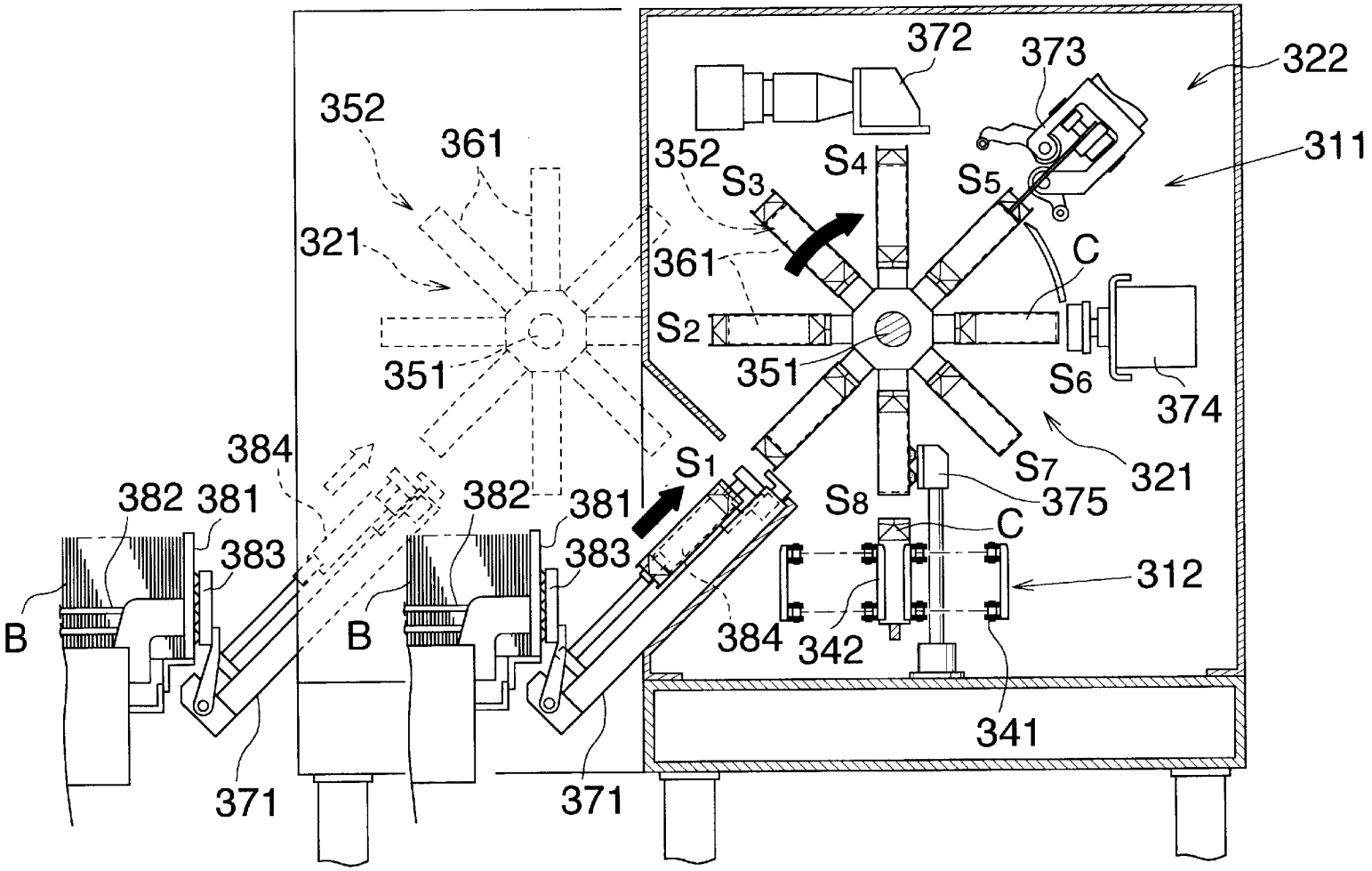
FIG. 10 is a view in vertical section taken along the line X—X in FIG. 9.
Figure 11:
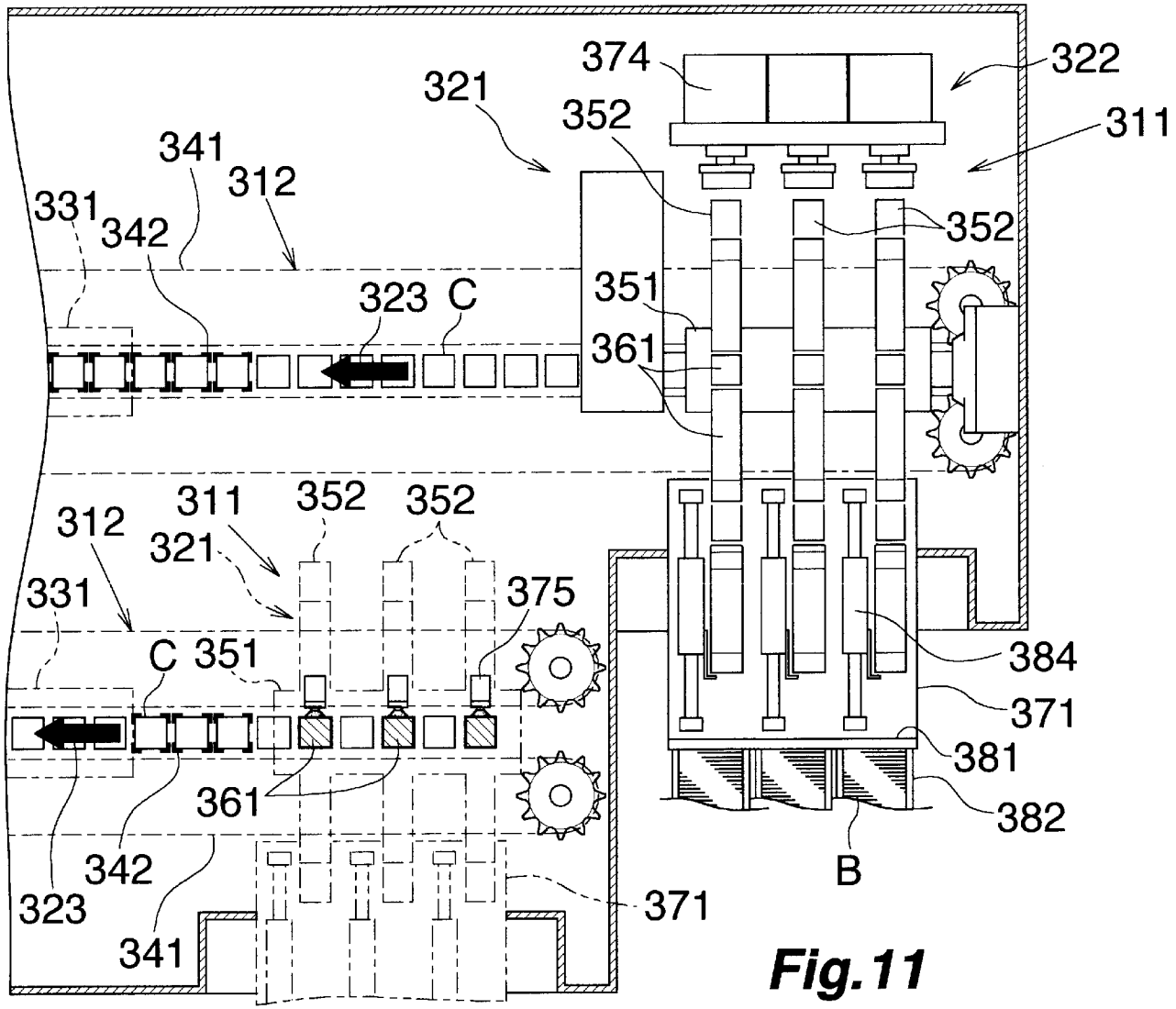
FIG. 11 is a view in horizontal section taken along the line XI—XI in FIG. 9.

With reference to FIGS. 9 to 11, a description will be given below of a packaging machine which is most suitable to incorporate the foregoing filling device 13 and cleaning device 14 therein.

In the following description, the terms "front" and "rear" are used based on FIG. 9; the left-hand side of the drawing is referred to as the "front," and the opposite side thereof as the "rear." The terms "left" and "right" refer respectively to the left and right sides of the machine as it is seen from the rear forward.

Referring to FIG. 9, the packaging machine comprises a container bottom forming apparatus 311 and a container conveyor 312 extending forward from the apparatus.

The container bottom forming apparatus 311 comprises left and right rotors 321, and first device groups 322 arranged at the left and right and each provided around the rotor 321.

The rotors 321 have the same construction, and the first device groups 322 are also of the same construction.

To avoid interference of the rotors 321 with each other, the right rotor 321 is positioned as shifted longitudinally of the apparatus to the rear of the left rotor 321.

The container conveyor 312 has left and right transport paths 323 extending forward in parallel to each other from below the respective rotors 321. The right transport path 323 is elongated rearward beyond the left path 323 by a length corresponding to the shift of one rotor 321 from the other rotor 321 in the longitudinal direction. The rear end of the right path 323 projects rearward beyond the left path 323 by the length.

Left and right second device groups 324 are arranged along the respective transport paths 323 from the rear forward. These groups are of the same construction and each include a primary top breaker 331, filling device 332, secondary top breaker 333, top heater 334 and top sealer 335. Unlike the rotors 321, these devices 331 to 335 along one path are not shifted from those of the other path, and are each positioned at the same position for both paths with respect to the longitudinal direction. Accordingly, the portion of the right path 323 on the right side of the left rotor 321 is an idle station.

Each transport path 323 is provided by a pair of left and right endless chains 341, and a multiplicity of holders 342 attached to the chains 341 at a specified interval.

FIG. 10 shows the right rotor 321 and the right device group 322 in solid lines.

The right rotor 321 comprises a horizontal shaft 351 positioned immediately above the right transport path 323 and extending in parallel to the path longitudinally thereof, and three mandrel rows 352 arranged in parallel at three axially spaced portions of the rotary shaft 351. Each mandrel row 352 comprises eight radial mandrels 361. The pitch of mandrel rows is twice the pitch of container holders 342.

FIG. 10 shows that one of the eight mandrels 361 providing each row 352 is at a halt as directed vertically downward. This position serves as the final station, i.e. an eighth process station S8. Arranged clockwise from this position are first to eighth process stations S1 to S8 as equidistantly spaced apart.

Three holders 342 are stopped at the same time by each cycle below the three mandrels 361 halted in the vertically downward position at the eighth station S8. For this purpose, the holders 342 are intermittently driven a distance corresponding to three times the holder pitch at a time.

The right first device group 322 comprises a feeder 371 disposed at the first process station S1, bottom heater 372 at the fourth process station S4, bottom breaker 373 at the fifth process station S5, bottom sealer 374 at the sixth process station S6 and unloader 375 at the eighth process station S8. These devices are provided in three sets in corresponding relation with the three mandrel rows 352.

While these feeder 371, bottom heater 372, bottom breaker 373, bottom sealer 374 and unloader 375 are of known construction and will not be described in detail, the feeder 371 will be described briefly. The feeder 371 comprises a magazine 382 so disposed as to position an outlet 381 as opposed to a phantom outward extension line of the mandrel 361 halted at the first process station S1, the magazine 382 having accommodated therein a stack of flat blanks B, a picker 383 for withdrawing the blanks B from the outlet 381 one by one while unfolding each blank into a tube of square cross section, and a loader 384 for fitting the withdrawn blank B around the mandrel 361.

The left and right feeders 371 are arranged at the left of the respective left and right rotors 321. The left transport path 323 of the conveyor 312 terminates at the location of the left rotor 321 as its rear end, without extending to the position at the left of the right rotor 321 to provide a vacant space at this position. Accordingly, the right feeder 371 can be installed in the vacant space without extending over or interfering with the left transport path 323.

By the feeder 371, three tubular blanks B of square cross section are fitted around and supplied to the three mandrels 361 halted at the first process station S1. Each blank B supplied has one end projecting from the mandrel 361 to provide the bottom of a container. The projecting end of the blank B is heated by the heater 372, folded by the breaker 373 so as to be closed, and the folded end portion is closed by the sealer 374, whereby a tubular container C having a bottom is formed. The three containers C fitted around the three mandrels 361 are removed from the mandrels 361 by the unloaders 375 at the same time, caused to descend as they are without rotation and held by three holders 342.

Each container C held by the holder 342 has the other end thereof for providing the top of the container prefolded by the primary top breaker 331, is filled with contents by the filling device 332, and has its prefolded end fully folded by the secondary top breaker 333. Subsequently, the folded end is heated by the top heater 334 and thereafter sealed off by the top sealer 335.

The conveyor 12, and the combination of filling device 13 and cleaning device 14 shown in FIGS. 1 to 8 correspond to the conveyor 312 and the filling device 332 shown in FIGS. 9 to 11.

What is claimed is:

1. A filling nozzle cleaning device comprising an adaptor having an upward socket connectable to a downward discharge outlet of a filling nozzle disposed above a bed, a collecting pipe integral with the adaptor so as to communicate with the socket, and a drive mechanism for moving the adaptor so as to advance the socket to below the discharge outlet or retract the socket from below the outlet and to connect the socket to the discharge outlet when the socket is advanced, the collecting pipe having a vertical pipe portion, the vertical pipe portion extending through the bed rotatably and upwardly and downwardly movable at a position away from the discharge outlet by a distance equal to the distance by which the socket is horizontally spaced apart from the vertical pipe portion, the drive mechanism having an actuator connected to the vertical pipe portion at a position below the bed for rotating and upwardly and downwardly moving the pipe portion.

2. A filling nozzle cleaning device according to claim 1 wherein a container conveyor extends below the filling nozzle, and a vertical tubular stand is installed on the bed and fitted around the vertical pipe portion so as to render the pipe portion free to rotate and move upward and downward, the stand being adjustable in position in directions parallel to a path of transport by the conveyor.

3. A filling nozzle cleaning device according to claim 2 wherein a cleaning nozzle having a downward cleaning opening is disposed below a path of rotation of the socket centered about the vertical pipe portion, and the cleaning nozzle is fixed to the stand.

4. A filling nozzle cleaning device according to claim 1 wherein the actuator comprises a rotary actuator having a body restrained from rotating about the axis of the vertical pipe portion but free to move upward or downward and a rotary shaft projecting upward from the body and connected to a lower end of the vertical pipe portion, and an actuator of the straight moving type having a straight movable rod extending in parallel to the axial direction of the vertical pipe portion and connected to the body.

5. A filling nozzle cleaning device according to any one of claims 1 to 4 wherein the vertical pipe portion has a collecting hole below the bed, and a shell is fitted around the pipe portion and covers the collecting hole, the shell rendering the pipe portion free to rotate and being movable with the pipe portion upward and downward, a flexible pipe having one end connected to the shell and the other end connected to a collecting pump.

* * * * *